US007642224B2

(12) United States Patent
McRae et al.

(10) Patent No.: US 7,642,224 B2
(45) Date of Patent: Jan. 5, 2010

(54) BIODEGRADABLE DETERGENT CONCENTRATE FOR MEDICAL INSTRUMENTS AND EQUIPMENT

(75) Inventors: Ann Kneipp McRae, St. Louis, MO (US); Jason Frank Tirey, Ballwin, MO (US); Stavroula Maria Heintz, Freeburg, IL (US); Nancy-Hope Elizabeth Kaiser, Pontoon Beach, IL (US); Kathleen A. Fix, Willoughby, OH (US)

(73) Assignee: American Sterilizer Company, Mentor, OH (US)

( * ) Notice: Subject to any disclaimer, the term of this patent is extended or adjusted under 35 U.S.C. 154(b) by 0 days.

(21) Appl. No.: 12/460,619

(22) Filed: Jul. 22, 2009

(65) Prior Publication Data

US 2009/0281014 A1 Nov. 12, 2009

Related U.S. Application Data

(62) Division of application No. 11/890,078, filed on Aug. 3, 2007.

(51) Int. Cl.
*C11D 1/08* (2006.01)

(52) U.S. Cl. ..... 510/108; 134/4; 134/34; 134/36; 134/40; 134/41; 134/42; 510/161; 510/245; 510/258; 510/264; 510/477; 510/480; 510/491; 510/501

(58) Field of Classification Search ..... 134/4, 134/34, 36, 40, 41, 42; 510/108, 161, 245, 510/258, 264, 477, 480, 491, 501
See application file for complete search history.

(56) References Cited

U.S. PATENT DOCUMENTS

| | | | | |
|---|---|---|---|---|
| 3,785,841 | A | 1/1974 | Beard | |
| 4,517,023 | A | 5/1985 | Barabas | |
| 5,215,676 | A | 6/1993 | Stone | |
| 5,489,666 | A | 2/1996 | Carey et al. | |
| 5,647,995 | A | 7/1997 | Kneller et al. | |
| 5,665,688 | A | 9/1997 | Honda et al. | |
| 5,849,095 | A | 12/1998 | Rouillard | |
| 5,929,008 | A | 7/1999 | Goldstein | |
| 6,034,046 | A * | 3/2000 | Blanvalet et al. | 510/362 |
| 6,210,600 | B1 | 4/2001 | Zhou et al. | |

(Continued)

FOREIGN PATENT DOCUMENTS

JP 2002-102886 4/2002

(Continued)

OTHER PUBLICATIONS

"Principles of Industrial Water Treatment," Drew Industrial Division, Ashland Chemical Company, Eleventh Edition 1994, pp. i, ii and 80-85.

*Primary Examiner*—Sharidan Carrillo
(74) *Attorney, Agent, or Firm*—Hudak, Shunk & Farine Co. LPA

(57) ABSTRACT

An aqueous, concentrated neutral detergent composition for use in cleaning medical instruments and metal components (parts, tools, utensils, vessels, equipment, and surfaces) having scale control and corrosion inhibition properties when diluted to about 1/40 ounce per gallon to about 1/10 ounce per gallon in potable water. In addition, the concentrate may be applied directly to metal surfaces, such as stainless steel, to remove rust and other stains, without causing any additional corrosion or other damage to the metal surface.

5 Claims, 1 Drawing Sheet

U.S. PATENT DOCUMENTS

2004/0102344 A1 5/2004 Nakayama et al.
2004/0244969 A1 12/2004 Kotlar et al.
2005/0247637 A1 11/2005 Sher et al.
2008/0108539 A1* 5/2008 Kany et al. ..... 510/402
2008/0221006 A1* 9/2008 Heisig et al. ..... 510/272

FOREIGN PATENT DOCUMENTS

WO WO 95/15984 7/1995

* cited by examiner

BIODEGRADABLE DETERGENT CONCENTRATE FOR MEDICAL INSTRUMENTS AND EQUIPMENT

CROSS REFERENCE

This is a division of U.S. application Ser. No. 11/890,078, filed on Aug. 3, 2007, for BIODEGRADABLE DETERGENT CONCENTRATE FOR MEDICAL INSTRUMENTS AND EQUIPMENT, currently pending.

FIELD OF THE INVENTION

This invention relates to a concentrated detergent composition for cleaning medical instruments and other equipment and hard surfaces. More particularly, this invention is directed to a user friendly, biodegradable detergent concentrate for use in cleaning medical instruments and other metal equipment and hard surfaces, which possesses scale control and corrosion inhibition properties that are maintained even upon dilution, as well as destaining and rust removal properties when used full strength. The aqueous, biodegradable detergent composition of the invention comprises a synergistic combination of surfactants, scale control agents, and corrosion inhibitors for soft metals, which is effective for achieving the aforenoted properties even when used at much lower dilution strengths than traditional cleaners.

BACKGROUND OF THE INVENTION

This invention is discussed with particular reference to, and primarily in terms of, its usefulness as a cleaner/detergent in hospitals for medical instruments and other metal equipment and components, but it is not limited to hospital use or cleaning medical instruments or equipment. As used herein, the term "medical instruments" is intended to mean and include a broad classification of objects, such as surgical instruments (scalpels, biopsy instruments, clamps and the like); endoscopes, proctoscopes, laparoscopes, colonoscopes, and other equipment used for medical or surgical procedures; other metal equipment used in the practice of medicine and/or dentistry as well as hard surfaces encountered in these practices, which require cleaning. In addition, this invention is also intended to include instruments, equipment, hard surfaces and the like in facilities that have similar cleaning requirements, such as, for example, pharmaceutical manufacturing facilities, dairy farms, water recycling, food processing, restaurants, hair salons, cosmetic treatments, veterinary practices, and any other application where cleaning of human or animal blood, protein, lipid soils, or other similar soils are required, and where there is a need for scale control, corrosion inhibition and destaining properties in an applied cleaning composition.

Detergents for use in cleaning medical instruments and other metal equipment (parts, tools, vessels, surfaces) are known in the art. While medical instruments and associated equipment may require sterilization, typically, such instruments and equipment are first cleaned and scrubbed to remove soils, including but not limited to blood, lipid and protein soils, with which they have been coated during use. Instruments/equipment should not be sterilized while they are coated with these soils, since the soil may set as a hardened residue which is difficult to remove later. Soil also presents a barrier to sterilant penetration.

Traditionally, instruments and equipment are manually scrubbed (or rinsed) with, or soaked in, a detergent cleaning solution to remove the bulk of the soil from their surfaces. Soil removal may also be accomplished by placing soiled devices in an automated washer. The volumes of traditional cleaning products used in an instrument processing department within a hospital, or other facility where such cleaning is necessary, are typically very large. In order to achieve high efficiency in processing medical instruments and other equipment, the change out of empty containers to full containers needs to be held to a minimum. As a result, traditional cleaning products are often manufactured as, and sold to, hospitals or other facilities in containers from 5 to 55 gallons. The weight and bulk of these containers poses an ergonomic risk to workers handling the containers. Additionally, the size of the containers occupies valuable space.

One currently available cleaning product addresses the ergonomic and storage space issues associated with bulk cleaning products. The cleaning product is a solid chemistry, which must be diluted in water prior to introduction to the washing or cleaning process. This dry product does not sufficiently protect medical (or other metal) instruments or automated instrument washers from corrosion caused by water and/or contaminants within the water. Nor does it contain sufficient amounts or types of components to prevent the formation of water hardness deposits or scale that result from using hard water (>100 ppm as $CaCO_3$), on medical instruments or other metal equipment, or in automated washers.

Ideally, a useful detergent composition for metal instruments, equipment and hard surfaces should provide for scale control, corrosion inhibition, and destaining of metal surfaces in one product. While most conventional cleaning compositions combine scale control and corrosion inhibition properties, destaining or rust removal is traditionally accomplished using a dedicated destainer that is a separate product. Eliminating the need for an additional destaining product is cost effective both with respect to processing and conserving valuable storage space.

An ideal detergent composition should also provide efficacious cleaning at low use dilutions, i.e., require less volume to clean effectively. Traditional detergents and cleaning chemistries used for cleaning medical instruments and other equipment and hard surfaces are typically diluted in water prior to use at dilutions ranging from about ⅛ oz./gal. to 2 oz./gal. or more. A cleaning concentrate that requires less volume to achieve the same or better cleaning efficacy and provides scale control, corrosion inhibition and destaining properties at low use dilutions is desirable from both cost and ergonomic considerations. Using less of a cleaning concentrate to achieve efficacy, scale control, and corrosion inhibition allows for smaller containers, or less change out of larger containers, and reduces the cost of materials for each cleaning process.

Conventional cleaning compositions achieve scale control and corrosion inhibition by using highly acid or alkaline cleaners containing chelants, sequestrants or other scale and corrosion inhibitors that are not biodegradable. Highly acid or alkaline cleaners are difficult to handle and present environmental, health and safety hazards for users. In addition, highly acidic cleaners, including many separate destainer products that are acidic, can themselves damage metal surfaces, thus making the metal susceptible to further corrosion.

Corrosion inhibition and scale control are easy to achieve and many currently available cleaning products are able to achieve these goals, albeit some products are better than others. Generally, scale control in cleaning concentrates has been and is being achieved by using a chelant for scale inhibition, such as EDTA (ethylene diamine tetra-acetic acid), NTA (nitrilotriacetic acid), phosphates, and phosphonates, which inhibit calcium and magnesium scale deposits, by chemically binding to calcium or magnesium cations, usually in a one-to-one molar ratio, to form a complex, i.e., a chelate. Drew Chemical Corp., *Principles of Industrial Water Treatment.,* 1984, pp. 80-84. In short, one molecule of the chelant combines with one or more ions of calcium, or another metal, to form a new complex. This complex prevents the calcium or magnesium cations from interacting with carbonate anions, thus preventing scale formation. Chelants also prevent metals, such as zinc, copper or iron, from depositing on an instrument or washer surface where they could cause staining or corrosion.

Sequestrants also are used to control scale formation. Sequestrants work in a different manner. One sequestrant molecule may interact with many metal ions and salts. Sequestrants do not prevent the formation of calcium or magnesium carbonate. Rather, they interact with the small calcium and magnesium carbonate particles preventing them from aggregating into a hard scale deposit. The particles repel each other and remain suspended in the water, or form loose aggregates which may settle. These loose aggregates are easily rinsed away and do not form a deposit.

In addition to the specific chelants described above, other compositions have also been used to control calcium carbonate scale and steel corrosion. One example is U.S. Pat. No. 5,647,995, which discloses a method to control scale and corrosion in cooling water using an alkali metal diphosphinate salt that is formed by reacting an acetylenic compound with an alkali metal hypophosphite in the presence of a free radical source. The diphosphinate salt is further reacted to prepare diphosphonate compounds and diphosphinate containing adducts, oligomers, and polymers having control scale and corrosion inhibiting properties.

Another example is U.S. Pat. No. 5,489,666 which discloses a composition for inhibiting the formation and deposition of calcium scales in a circulating aqueous system, such as a cooling water system. The composition used to treat the water is a modified poly-epoxysuccinic acid, which is stated to be effective at conditions of high pH, high calcium concentration and high M-alkalinity, where conventional treatments lose efficacy.

U.S. 2005/0247637 A1 discloses a water treatment for scale control in hard water, which can be used in boilers, or other heating units, hot pipes for commercial, industrial and domestic uses, particularly for drinking water treatment, food service vending and dispensing machines with internal mixing surfaces, boiler or on demand heating elements and similar components. The treatment comprises the combination of metal particulates, e.g., zinc and copper, along with polyphosphates, which is stated to drastically reduce the scale deposition on internal surfaces of high cycle food or beverage dispensing systems with a synergistic effect compared to use of the components alone.

EP 0733073 (WO 95/15984) discloses a carboxymethyl inulin having degrees of substitution (D.S.) ranging from 0.15 to 2.5, which is stated to be useful as an inhibitor of the crystallization of calcium carbonate and is biodegradable. No specific cleaning formulations are disclosed.

Many of the traditional chelants, sequestrants and other scale control agents, including several discussed above, have been the subject of increased regulatory scrutiny due to their impact on the environment. Moreover, conventional concentrated detergents generally require a chelant concentration of 10% or greater in order to be effective when diluted. Typical medical instrument cleaners are diluted to ⅛-2 oz./gal. (in water) resulting in a concentration of 195 ppm to 781 ppm of active chelant/inhibitor in the wash solution. It would be desirable to achieve scale control using a lower concentration of detergent/cleaner to minimize costs, while achieving the same or better results than prior art compositions and having the added advantage of being user and environmentally friendly.

In addition to scale control, control of corrosion in medical instrument and equipment processing is critical to maintaining their safe and effective operation. Many instruments and equipment contain soft metals, such as copper, brass, aluminum and anodized aluminum, which are very susceptible to damage from both the detergents and the water in which they are processed. Typically, neutral cleaning chemistries are used to process these soft metals; however, currently available neutral chemistries, such as STERIS Corporation's Renu-Klenz and NpH Klenz, contain phosphate or phosphonate-based corrosion inhibitors, which are less environmentally friendly. Traditional corrosion chemistries are also diluted to amounts ranging from ⅛ to greater than 2 oz./gal. This level of dilution necessitates large containers of traditional chemistries, which presents an ergonomic risk to instrument reprocessing workers and takes up valuable storage space as well.

Like traditional scale control components, the phosphates and phosphorous containing chemistries used for corrosion inhibition are subject to increasing scrutiny for environmental reasons. As regulations, both international and domestic, become more stringent, the need to replace phosphorous containing chemistries is necessary. Hence, consumer preference and demand for phosphate-free chemistries is expected to increase.

Soft metals are increasingly being used in medical instruments and equipment. As phosphates and phosphate-containing materials are phased out by environmental pressures, maintenance of metal instruments and equipment made from soft metals will be much more difficult, without developing new chemistries to inhibit corrosion. Thus, there is a need for new cleaning compositions that achieve corrosion inhibition with soft metals that is the same or better than that achieved with currently available cleaners and that have a minimal effect on the environment.

In addition to scale and corrosion issues, medical instruments and equipment frequently become stained with various metal deposits and corrosion products. In order to maintain their proper function, halt corrosion, and maintain the appearance of the instruments or equipment, it is necessary to remove the stains or corrosion from the surface of the metal. Conventional destaining and corrosion (rust) removing products are acidic (sometimes highly acidic) and may or may not contain abrasives. For example, U.S. Pat. No. 5,215,676 discloses a chemical composition consisting of a very low pH mixture of hydrochloric and phosphoric acids along with organic ammonium chlorides and organic sulfate, which is stated to be effective for the removal of rust and stains from a variety of surfaces, including metal, concrete, plastic, wood and fiberglass surfaces and non-corrosive to metals. U.S. Pat. No. 4,517,023 discloses a method to remove rust from metal surfaces by applying a coating of an aqueous solution of a copolymer of maleic acid and monomer, which is coated on the metal surface, allowed to dry and is later detached along with the rust from the surface. U.S. 2004/0102344 A1 is a composition for rust removal which comprises a basic compound (such as sodium hydroxide, potassium hydroxide, ammonium hydroxide, and various amines or salts thereof), a water soluble chelating agent, and thiourea dioxide, which gives an alkaline solution when dissolved in aqueous medium and which is stated to have a synergistic effect over any component alone or any two components in combination. The composition is stated to be useful to remove rust occurring on machines and instruments for medical use, such as a dialyzer, water treatment, water pipes, and surroundings.

Acidic rust removers or destainers can damage the surface of metal, if used improperly. For stainless steel, it is expected that staining and/or corrosion will damage the passive layer to some extent. The passive layer of stainless steel is a very thin layer of metal that has a ratio of chromium to iron content that is higher than the bulk metal. The increased chromium content increases the corrosion resistance of the metal. This natural passive layer occurs on stainless steel anytime it is exposed to the air. However, the layer is not very robust and is more susceptible to corrosion than chemically passivated (e.g., using nitric acid, phosphoric acid, citric acid) stainless steel. If an acidic destaining product is used over a larger area, or if it is left in contact with the surface too long, corrosive damage can occur. As such, once the metal is exposed to water, it is more susceptible to corrosion than chemically passivated stainless steel. A similar effect can be seen when products with abrasives are used. Abrasive products scratch the passive layer and create potential sites for future corrosion.

Based on the foregoing, currently available concentrated cleaners present many disadvantages in their use. Many are not biodegradable or user or environmentally friendly, but are subject to strict environmental scrutiny, and present health and safety concerns for workers. Highly acidic and alkaline cleaners present not only safety hazards, but also limit the usable life of medical instruments and other equipment upon which they are used due to their additive corrosive effect. Large volumes are often required to be on site and for efficiency in operations, large containers are often used for detergent supply. These large containers occupy valuable space and present ergonomic risks due to the bulk and weight of the product containers. None of the conventional products achieve both corrosion inhibition and scale control at lower concentrations, and none combine, in one product, destaining ability along with scale control and corrosion inhibition properties.

A new, highly concentrated detergent composition comprising a synergistic combination of corrosion inhibitors, scale control components (chelants, sequestrants), surfactants and a buffer system has been discovered, which surprisingly combines the properties of biodegradability, neutrality, corrosion inhibition, scale control and destaining in one concentrated formulation. The composition also provides effective corrosion inhibition and scale control when used in much lower concentrations ranging from 1/40 oz./gal. to ppm 1/10 oz./gal. than concentrations required by traditional agents. In addition, the composition can, when applied directly to stained metal surfaces, be used to remove stains without damaging the surface of the metal after a contact time of 15 minutes to one hour.

The composition's buffer system provides a neutral pH, which is important to both the physical stability of the composition and its compatibility with metals. The composition also uses a surfactant system which is essential to maintaining the stability of the entire composition and for wetting the surface of the metal.

A primary advantage of the inventive composition is the reduction in costs of processing and ergonomic risk and storage space due to its highly concentrated nature and the low use dilutions required. Even at use dilutions of 1/10 the amount of traditional cleaners, the inventive composition provides efficacious cleaning, while maintaining instrument integrity and controlling water hardness and corrosion at least as well as that achieved with traditional chemistries. The inventive composition eliminates the need for an additional product for destaining metal and is safer and less corrosive when compared to destaining products that are acidic.

Generally, the aqueous, concentrated biodegradable cleaner of the invention comprises the following components:

a) at least one surfactant;

b) at least one scale control component;

c) at least one corrosion inhibitor;

d) a buffer system to maintain a neutral pH; and e) water.

Other components may be added as well, such as dyes, perfumes, coupling agents, defoamers, disinfectants, enzymes, solvents and the like.

It is an object of this invention to provide a concentrated cleaning composition for use on medical instruments and equipment and hard surfaces, which avoids the above discussed disadvantages of the conventional compositions and provides a commercial, cost effective alternative.

It is a further object of this invention to provide a concentrated cleaning composition which is safe to handle and use and is environmentally friendly.

It is a further object of this invention to provide a single concentrated cleaning composition for use in cleaning medical instruments, equipment and hard surfaces, without the need for adjunctive cleaners for destaining.

Yet a further object of this invention is to provide in a single concentrated cleaning composition the desired properties of scale control and corrosion inhibition, which are maintained even as the concentrated cleaning composition is diluted.

A further object of this invention is to provide a concentrated cleaning composition, which requires less of the concentrate to be diluted to achieve the above advantages thus reducing costs.

A further object of this invention is to provide a concentrated cleaning composition, which requires less of the concentrate to achieve the same effectiveness as traditional cleaners, thus reducing the need for large volume containers to store the cleaning composition supply and the space needed to store the supply of cleaning concentrate.

SUMMARY OF THE INVENTION

The invention comprises a novel aqueous concentrated composition for cleaning medical instruments and other equipment and hard surfaces, which comprises a synergistic combination of chelants, sequestering agents, corrosion inhibitors and surfactants. The inventive compositions are environmentally friendly, safe to handle and economical. Advantageous properties, such as scale control and corrosion inhibition are maintained even when used in diluted form at dilution strengths well below that used for conventional, traditional cleaning compositions. Thus, the lower amount of the inventive concentrate necessary to achieve these properties provides an extremely cost effective alternative.

The inventive composition surprisingly provides not only scale control and corrosion inhibition properties, but also destaining properties, in one composition, thus eliminating the need for additional destaining products. In addition, because the concentrate performs well at much lower dilution uses than traditional concentrated medical instrument or metal component cleaners, smaller containers and less storage space are needed, thus reducing ergonomic risks.

Generally, the inventive cleaning concentrate is a pH neutral composition comprising a synergistic combination of components, such as:

a. a surfactant system;

b. scale control component(s);

c. corrosion inhibitor(s); and d. water.

Other adjuvants may be added, such as buffers, dyes, perfumes, disinfecting agents (peroxides, phenols, quaternary amines, etc.), proteolytic or other enzymes without affecting the advantageous properties achieved.

BRIEF DESCRIPTION OF THE DRAWING

The invention will be better understood and other features and advantages will become apparent by reading the detailed description of the invention, taken together with the drawings, wherein.

DETAILED DESCRIPTION OF THE INVENTION

Figure 1:
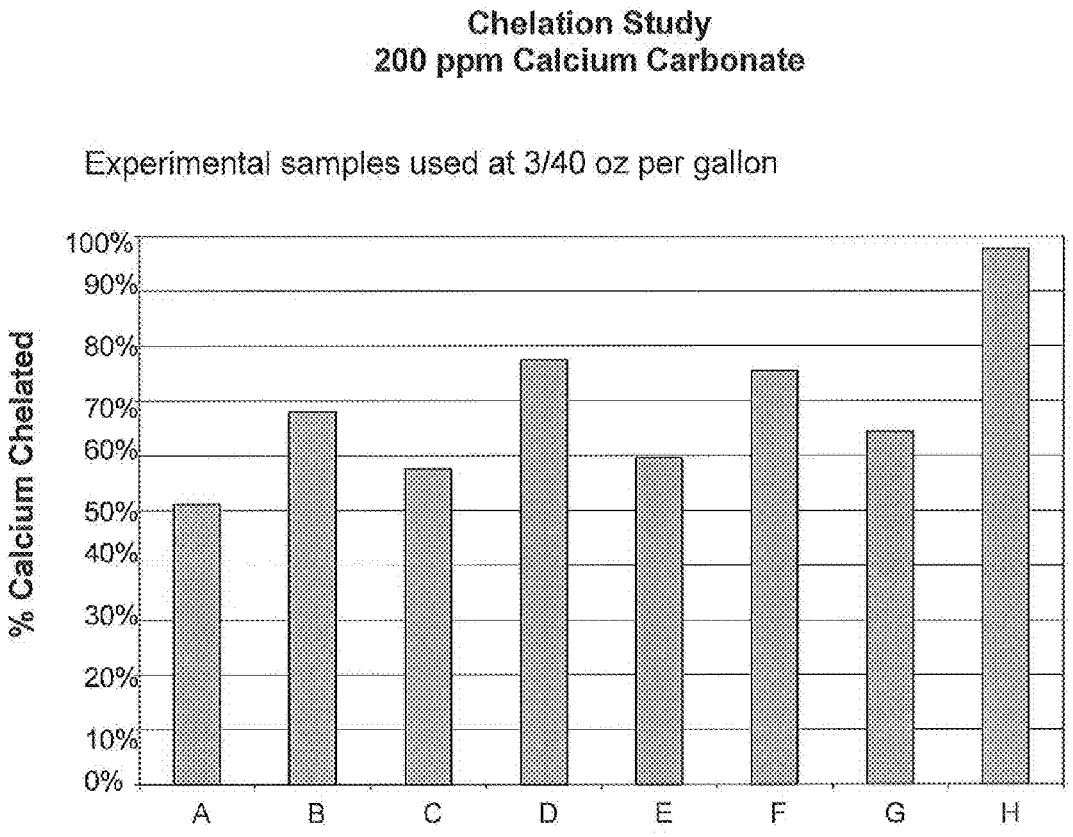
FIG. 1 shows the results of the scale inhibition/control experiment (chelation study) using 3/40 oz. of the inventive compositions in water.

The invention is described with reference to the primary properties of scale control, corrosion inhibition and destaining. The invention is a concentrated cleaning composition comprising surfactants, corrosion inhibitors and scale control components in an aqueous base having a neutral pH. In one embodiment, the inventive composition comprises scale control components that include both chelants and sequestrants; at least two corrosion inhibitors that are effective with soft metals; a combination of at least two surfactants, at least one of which is amphoteric; buffers to maintain a neutral pH; and water. The components of the inventive formulations are user and environmentally friendly. The components also appear to act synergistically to achieve scale control, corrosion inhibition and destaining properties, thus resulting unexpectedly in much lower use dilutions than that used for previously known cleaning compositions.

Accordingly, a unique feature of the inventive formulations is that they achieve their advantageous properties at lower use concentrations than conventional cleaning concentrates. The inventive formulations effectively inhibit corrosion of soft metals in both tap water and deionized water at use dilutions of 1/10 oz./gal. to 1/40 oz./gal. of the concentrated detergent formulation in water (as compared to the 1/8 oz./gal. to 2 oz./gal. use dilutions of conventional cleaners). They are also able to control scale formation in use dilutions at 1/10 the amounts of traditional cleaners that are normally used for medical equipment cleaning. The preferred diluted composition results in active concentrations chelant/inhibitor ranging from 15 to 25 ppm for a use dilution of about 1/40 oz./gal. to 65-100 ppm for use dilutions of about 1/10 oz./gal.

The inventive formulations also provide for stain or rust removal (destaining), which is easily achieved by applying the concentrated detergent directly to a metal surface, such as stainless steel. While not wishing to be bound by any theory, it is believed that the particular combination of components selected for the inventive compositions, as opposed to one specific component, work synergistically to provide this unique property in a neutral concentrated detergent. As a result, there is no need for a separate product for destaining purposes, and the use of the concentrate does not impart additional damage to the metal surface.

In most embodiments, a buffer system is an important component as the pH of the system is important to both physical stability and compatibility with metals. Additionally, the surfactant system is essential to maintaining the stability of the entire formulation.

Scale Control

Scaling is a result of water hardness. Scale is a hard, adherent mineral composition, such as calcium or magnesium, which usually exists in a crystalline form. Scale deposition is a process which occurs when temperature, pH, concentration, flow rate, pressure or other water conditions are changed. Water contains a large number of potential scale-causing constituents, such as calcium and magnesium ions, silica compounds, iron, and other minerals.

Preferably, the inventive combinations achieve scale control by the use of two separate, synergistic components—chelants and sequestrants. While either chelant or sequestrant chemistry can achieve scale control independently, unexpected synergistic results have been achieved with the unique combination of components utilized in the invention, and thus a combination of chelants and sequestrants is preferred.

Chelants work by combining with metals including calcium and magnesium to form a complex known as a chelant, which keeps the calcium or magnesium cations from interacting with the carbonate anions, thus preventing scale formation. They also prevent metals such as zinc, copper or iron from depositing on an instrument or washer surface where they could cause staining or corrosion. On the other hand, sequestrants work in a different manner. Sequestrants do not prevent the formation of calcium or magnesium carbonate. Rather, they interact with small calcium and magnesium carbonate particles preventing them from aggregating into a hard scale deposit. The particles repel each other and remain suspended in the water, or form loose aggregates which may settle. These loose aggregates are easily rinsed away and will not form a deposit.

Hence, a key aspect of the scale control property of the inventive compositions is attributable, generally, to the use of two different types of chemistries included in the detergent compositions. While these two chemistries (chelant and sequestrant) can achieve scale control independent of the other, it has been found that there is a synergistic effect between them that allows scale control in tap (potable) water at very low use dilutions (1/40-1/10 oz./gal.).

The chemistries for scale control are relatively new on the market and are biodegradable. Useful sequestrants for the inventive compositions may include sodium polyaspartate (Baypure DS 100) and sodium carboxymethyl inulin with carboxylate substitution degrees (DS) of 1.5, 2.0 and 2.5, respectively (i.e., currently known as Dequest PB 11615, Dequest PB11620 and Dequest PB11625 or Dequest SPE 15625, respectively. SPE indicates an experimental name, so the final marketed name may be different). A preferred sequestrant is sodium carboxymethyl inulin (DS 2.5). Another preferred sequestrant is sodium carboxymethyl inulin (DS 2.0 or 2.5). Still another preferred sequestrant is sodium polyaspartate.

Sequestrant scale control inhibitors are present in the inventive formulation(s) in amounts ranging from about 1 to about 10 wt. %, more preferably from about 2 to about 7 wt. %, and most preferably from about 3 to about 5 wt. %, based upon the total weight of the concentrate. More than one scale control inhibitor may be used, and the ranges describe the total amount of scale control inhibitors in the inventive formulation.

Chelants are also used for scale control. The chelants selected for use in the claimed invention may include methyl glycine diacetic acid (MGDA, available as Trilon M), sodium glucoheptonate (Burco BSGH-400), disodium hydroxyethyliminodiacetic acid (XUS 40855.01), imino disuccinic acid (Baypure CX 100/34 or Baypure CX 100 Solid G), EDDS ([S,S]-ethylenediamine-N,N'-disuccinic acid) (Octaquest A65 or Octaquest E30), citric acid, glycolic acid and lactic acid. A preferred chelant is imino disuccinic acid tetrasodium salt. Another preferred chelant is methyl glycine diacetic acid trisodium salt. Yet another preferred chelant is EDDS.

Chelants are present in the inventive formulation(s) in amounts ranging from about 2 to about 20 wt. %, more preferably from about 5 to about 15 wt. %, and most preferably from about 8 to about 12 wt. %, based upon the total weight of the concentrate. More than one chelant may be used, and the ranges describe the total amount of chelants in the inventive formulation.

Corrosion Inhibition

In the presence of water, blood or other bodily soils, or corrosive fluids, metal instruments/equipment tend to begin to corrode instantaneously. The inventive concentrate, therefore, preferably comprises one or more corrosion inhibitors. While corrosion inhibitors are generally selected in accordance with the nature of the materials in the metal to be cleaned, making it desirable to have one or more corrosion inhibitors so that the composition can be used on a variety of metals, it is important to select those inhibitors that are more environmentally friendly.

In the context of the present invention, the corrosion inhibition property is achieved primarily with the use of corrosion inhibitors, but the scale control components and the surfactants have an effect as well. Exemplary copper and brass corrosion inhibitors are generally nitrogen or oxygen containing organic compounds, such as amine, nitrate compounds, benzoates, azoles, imidazoles, diazoles, triazoles, carboxylic acids and the like. Azoles such as mercaptobenzothiazole, and aromatic triazoles and their salts, such as benzotriazole, tolyltriazole, and sodium tolyltriazole, are particularly suitable as copper and brass corrosion inhibitors. A combination of azole-based corrosion inhibitors is available, for example as Cobratec™ 939 from PMC.

Unique inhibitors from the above list may also provide corrosion inhibition to aluminum. The tricarboxylic acid and/or the quaternary amine compositions discussed below (e.g., Carboshield 1000) provide protection to aluminum and aluminum alloys. Like the achievement of scale control discussed above, a unique feature of the inventive compositions is metal protection at low use dilution concentrations.

Corrosion inhibitors useful in the claimed invention include undecanedioic acid (Irgacor DC 11), dodecanedioic acid (Irgacor DC 12), ethanol, 2,2'-[[methyl-1H-benzotriazole-l-yl)methyl]imino]bis- (Irgamet 42), 6,6',6"-(1,3,5-triazine-2,4,6-triyltrimino)tris(hexanoic acid) Irgacor L190), didecyl dimethyl ammonium bicarbonate/carbonate (CarboShield 1000), sodium tolyltriazole and benzotriazole. The preferred systems contain synergistic combinations having as one component any of sodium tolyltriazoles, sodium benzotriazole, or Irgamet 42 for yellow metals (copper, brass, etc.), and as the other component Irgacor L 190, Irgacor DC 11, Irgacor DC 12 or CarboShield 1000.

Corrosion inhibitors are present in the inventive formulation(s) in amounts ranging from about 5 to about 25 wt. %, more preferably from about 10 to about 20 wt. %, and most preferably from about 12 to about 18 wt. %, based upon the total weight of the concentrate. More than one corrosion inhibitor may be used, and the ranges describe the total amount of corrosion inhibitors in the inventive formulation.

Buffers

Buffers are used at an amount effective to maintain the pH of the detergent composition at 6.5 to 9.0, preferred pH 7.0 to 8.0. Buffer systems that are useful include citric acid with potassium hydroxide or sodium hydroxide or ethanolamine or triethanolamine (TEA) with a suitable acid such as glycolic or lactic acid. Organic acids are most preferred, because they buffer more easily and are less likely to interfere with the corrosion system. Other buffer systems are well known to one skilled in the art.

Surfactants

Useful surfactants for the inventive compositions may be amphoteric, zwitterionic, anionic, and nonionic surfactants. Surfactants falling within these classifications are well known in the detergent art. Preferred surfactants are zwitterionic, although amphoteric, anionic and nonionic surfactants may be used. Nonionic surfactants are least preferred since they require a coupling agent to remain in solution with the scale control system. However, in the presence of an appropriate coupling system, nonionic surfactants are also useful.

Surfactants are present in the inventive formulation(s) in amounts ranging from about 10 to about 50 wt. %, more preferably from about 15 to about 40 wt. %, and most preferably from about 20 to about 30 wt. %, based upon the total weight of the concentrate. More than one surfactant may be used, and the ranges describe the total amount of surfactants in the inventive formulation.

The balance of the inventive composition is water.

As stated above, the inventive composition has a neutral pH (6.5-9.0) in concentrate and dilute form. A neutral detergent product is safer for the end user as it is not corrosive to the skin. In addition, a neutral destaining (rust removal) product has inherent advantages over acidic and abrasive destaining products. A neutral composition is less likely to damage metal surfaces and can be used on various metal surfaces, not just stainless steel.

The inventive detergent compositions are economical in that they are able to control corrosion, scale formation, and discoloration/staining of copper, brass, aluminum, and anodized aluminum in tap water and deionized water at dilutions of 1/40 oz. per gallon up to 1/10 oz. per gallon.

The detergent compositions of the invention are phosphate and EDTA-free, and thus more friendly to the environment. The components are also biodegradable which also minimizes the effects on the environment.

The highly concentrated compositions of the invention are physically stable and have a long shelf life. In addition, by concentrating the components and the lower use dilution, the traditional fifteen gallon container used for detergent supply may be replaced by a smaller (1.5 gallon) container and the costs of processing are also reduced.

EXAMPLES

The examples below illustrate several embodiments of the inventive compositions and the advantages achieved. The invention is not intended to be limited by the examples, and it is to be appreciated that one skilled in the art would understand that a variety of compositions can be prepared, by following the teachings herein, which would achieve the same results.

Example 1

Experiments were conducted to determine scale inhibition/control properties of various formulas falling within the scope of the invention.

Table I lists the components, and weight % for each component for the inventive formulations tested.

TABLE I

| Component | Scale Control Formulations A | B | C | D | E | F | G | H |
|---|---|---|---|---|---|---|---|---|
| Octyl Betaine | 25 | 25 | 25 | 25 | 25 | 25 | 25 | 25 |
| Capryloaminoprorpyl Betaine | 10 | 10 | 10 | 10 | 10 | 10 | 10 | 10 |
| Imino disuccinic acid | | | 10 | 10 | | | 10 | 10 |
| Methyl Glycine Diacetic acid | 10 | 10 | | | 10 | 10 | | |
| Polyaspartic acid | 3.3 | | 3.3 | | 3.3 | | 3.3 | |
| Carboxylmethyl inulin | | 3.3 | | 3.3 | | 3.3 | | 3.3 |
| Sodium Tolyltriazole | 5 | 5 | 5 | 5 | 5 | 5 | 5 | 5 |
| Didecyl dimethyl ammonium bicarbonate/carbonate | 5 | 5 | 5 | 5 | | | | |
| Irgacor L-190 | 10 | 10 | 10 | 10 | 10 | 10 | 10 | 10 |
| Citric Acid | 0.54 | 0.52 | 1.21 | 1.16 | 0.79 | 0.33 | 1.34 | 1.20 |
| TEA | 1.62 | 1.61 | 1.66 | 1.70 | 1.59 | 1.00 | 1.64 | 1.81 |
| Soft Water | 29.54 | 29.57 | 28.83 | 28.84 | 34.32 | 35.37 | 33.72 | 33.69 |

Samples of the above formulations were used at a concentration of ¾₀ oz./gal. For each formula, an aliquot was dispensed into a jar containing 96 ml deionized water, and 2 ml each of 0.1 M calcium chloride and 0.1 M sodium carbonate. The water hardness of each sample jar was 200 parts per million (ppm). Sample jars were incubated at 50° C. for 24 hours. After incubation, each sample was filtered then acidified with a 10% nitric acid solution. The filtrate was analyzed via ICP for calcium content. The results of the scale inhibition/control experimental are shown in FIG. 1.

FIG. 1 illustrates that formulations of the present invention showed scale control/inhibition at use dilution concentrations of ¾₀ oz./gal. of at least 50% calcium chelated, with at least one formulation achieving scale control of >95% calcium chelated. The inventive formulations are able to provide effective scale inhibition in water hardness comparable to that found throughout approximately 80% of the United States, potentially making these formulations widely acceptable in the market. This scale inhibition was achieved quite unexpectedly at use dilutions far below those typically employed with traditional cleaning chemistries.

Example 2

Experiments were conducted to perform compatibility studies of the inventive formulations with soft metals (Copper, Brass, Anodized Aluminum). Test coupons of each metal and metal alloy were cleaned and weighed to the nearest 0.0001 g. A ²⁄₁₀ oz./gal. dilution of each formulation set forth in Table 1 was made using tap water. This dilution was selected per an existing test method which requires a dilution of two times (2×) the highest concentration recommended on the label to be used for materials compatibility testing. This ensures that the use of the product at its recommended concentrations will not be detrimental to soft metals. The use of tap water in this test mimicked real-life wash conditions for the metals. A coupon of each metal was placed in each dilution and incubated at 50° C. for 48 hours. After incubation, the coupons were removed from the test dilutions, rinsed and dried, then reweighed to the nearest 0.0001 g. Weight differences were used to calculate the corrosion rate in mils per year (mpy) for each coupon. The results of the experiments for samples of the above formulations used at concentrations of ²⁄₁₀ oz./gal. are shown below in Table II.

TABLE II

| | Corrosion/Inhibition Results Copper | Brass | Aluminum | Anodized Al |
|---|---|---|---|---|
| A | 0.11 Unchanged | 0.04 Unchanged | −0.74 Discolored (slight to none) | −1.60 Unchanged |
| B | 0.08 Unchanged | 0.08 Unchanged | −0.25 Discolored (slight) | −1.73 Unchanged |
| C | 0.11 Unchanged | 0.16 Darker Overall | −0.74 Discolored (slight, small spot) | −1.48 Unchanged |
| D | 0.00 Unchanged | 0.04 Unchanged | −0.12 Discolored (moderate) | −1.48 Unchanged |
| E | 0.04 Unchanged | 0.04 Unchanged | 0.25 Discolored (severe) | −1.23 Unchanged |
| F | 0.00 Unchanged | −0.08 Unchanged | −0.25 Discolored (slight at one end) | −1.48 Unchanged |
| G | 0.04 Unchanged | 0.04 Unchanged | −0.12 Discolored (severe) | −1.23 Unchanged |
| H | −0.11 Unchanged | 0.12 Unchanged | −0.12 Discolored (slight at one end) | −1.73 Unchanged |

Table II shows that formulations of the present invention exhibited soft metal compatibility and protection when used at concentrations of only ²⁄₁₀ oz./gal. This use dilution is far below the dilution at which traditional cleaners having metal protection chemistries are used. Acceptable results were those that demonstrated no visible changes to the metal and/or mpy values of less than 1.

Example 3

Evaluation of Stability and Efficacy

A series of concentrated formulations were prepared with various chelants and corrosion inhibitors to evaluate stability and efficacy. Because of the highly concentrated nature of the inventive formulations, achieving long-term stability of a fully formulated product presented a challenge. As a part of the experimental work, physical product stability was evaluated under accelerated conditions (storage at 40° C. and 50° C.). The formulations set forth in Table III were evaluated.

TABLE III

| Component | A | B | C | D | E | F | G |
|---|---|---|---|---|---|---|---|
| | Formulations for Stability Studies | | | | | | |
| Octyl Betaine | 25 | 25 | 25 | 25 | 25 | 25 | 25 |
| Capryloaminopropyl Betaine | | | | 10 | 10 | 10 | 10 |
| Mackam ODP-45M | 5 | 5 | 5 | 5 | | | |
| Imino disuccinic acid | 10 | 10 | 10 | 10 | | 10 | 10 |
| Methyl Glycine Diacetic acid | | | | | 10 | | |
| Polyaspartic acid | | | | | | 3.3 | |
| Carboxylmethyl inulin | 3.3 | 3.3 | 3.3 | 3.3 | 3.3 | | 3.3 |
| Sodium Tolyltriazole | 5 | 5 | 5 | 5 | 5 | 5 | 5 |
| Irgacor L-190 | 10 | 10 | 10 | 10 | 10 | 10 | 10 |
| Citric Acid | 1.88 | 2.93 | 1.17 | 1.47 | 0.33 | 1.34 | 1.20 |
| TEA | 2.25 | 5.90 | | 1.81 | 1.00 | 1.64 | 1.81 |
| Soft Water | 37.57 | 32.87 | 40.53 | 28.42 | 35.37 | 33.72 | 33.69 |

The formulations were evaluated in concentrated form. They were analyzed for viscosity, pH, clarity and appearance. All formulations exhibited excellent physical stability for all criteria under the described accelerated conditions after a minimum of two weeks storage time. Viscosity of all formulations remained constant between 8 and 15 centipoise over time. pH shifts were minor, the majority being ±0.05 or less. All formulations remained clear and exhibited no color changes over time regardless of storage conditions.

Example 4

Destaining Experiments

Severely stained and damaged basins, after an estimated two years treatment with a conventional cleaner were tested with the inventive formulations to determine if cleaning at concentrated levels could remove stains and/or repair damage.

A metal basin was divided into sections using tape. Each of four sections had a different product/formulation applied. Once applied, the sections were allowed to sit at room temperature for 30 minutes. The sections were then rubbed with a wet paper towel to remove the dried product and any stains. The results were document photographically. The portion of the basin treated with Formula E (from Table III) showed the most improvement with the best final appearance and was superior in destaining as compared to the other chemistries applied. The second best improvement was attributed to application of an acidic product manufactured by Steris Corporation known as S-Klenz. Of the two remaining chemistries applied, more improvement was seen in the section treated with an alkaline product, also manufactured by Steris, known as Criti-Klenz Liquid Concentrate, as compared to application of a five percent solution of a neutral solid product composed primarily of surfactants and urea.

It will be understood by those who practice the invention and those skilled in the art that various modifications and improvements may be made to the invention without departing from the spirit of the disclose concepts. The scope of protection afforded is to be determined by the claims and by the breadth of interpretation allowed by law.

What is claimed is:

1. A concentrated cleaning composition consisting of:

a surfactant consisting of octyl betaine, or capryl aminopropyl betaine, or disodium ethylhexyliminodipropionate, or mixtures thereof, present in amounts ranging from about 10 wt. % to about 50 wt. %;

a corrosion inhibitor consisting of sodium tolyltriazole, or benzotriazole, or a polycarboxylic acid, or didecyl dimethyl ammonium bicarbonate/carbonate; or ethanol, 2,2'-[[(methyl-1H-benzotriazole-1-yl)methyl]imino] bis-; or mixtures thereof, present in amounts ranging from about 5 wt. % to about 25 wt. %;

a scale control component consisting of a chelant and a sequestrant, wherein the chelant consists of methyl glycine diacetic acid, or sodium glucoheptonate, or disodium hydroxyethyliminodiacetic acid, or iminodisuccinic acid, or S,S-ethylenediamine-N,N'-disuccinic acid, or mixtures thereof, and is present in amounts ranging from about 2 wt. % to about 20 wt. %; and wherein the sequestrant consists of sodium polyaspartate, or sodium carboxymethyl inulin, or mixtures thereof; and is present in amounts ranging from about 1 wt. % to about 10 wt. %;

a buffer system; and water, wherein the wt. % is based upon the total weight of the concentrated cleaning composition.

2. The concentrated cleaning composition according to claim 1, wherein the polycarboxylic acid is 6,6',6"-(1,3,5-triazine-2,4,6-triyltriimino)tris(hexanoic acid).

3. A concentrated cleaning consisting of:

a surfactant system consisting of octyl betaine and capryl aminopropyl betaine;

scale control components consisting of methylglycine diacetic acid and sodium carboxymethyl inulin;

corrosion inhibitors consisting of sodium tolyltriazole and 6,6',6"-(1,3,5-triazine-2,4,6-triyltriimino)tris(hexanoic acid);

a buffer system; and water.

4. A concentrated cleaning composition consisting of:

a surfactant system consisting of octyl betaine and disodium ethylhexyl iminodipropionate;

scale control components consisting of iminodisuccinic acid and sodium carboxymethyl inulin;

corrosion inhibitors consisting of sodium tolyltriazole and 6,6',6"-(1,3,5-triazine-2,4,6-triyltriimino)tris(hexanoic acid);

a buffer system; and water.

5. A concentrated cleaning composition consisting of:

a surfactant system consisting of octyl betaine and capryl aminopropyl betaine;

scale control components consisting of iminodisuccinic acid and sodium polyaspartate;

corrosion inhibitors consisting of sodium tolyltriazole and 6,6',6"-(1,3,5-triazine-2,4,6-triyltriimino)tris(hexanoic acid);

a buffer system; and water.

* * * * *